US005898258A

United States Patent [19]

Sakai et al.

[11] Patent Number: 5,898,258

[45] Date of Patent: Apr. 27, 1999

[54] FIELD EMISSION TYPE COLD CATHODE APPARATUS AND METHOD OF MANUFACTURING THE SAME

[75] Inventors: Tadashi Sakai; Tomio Ono, both of Yokohama; Li Zhang, Tokyo, all of Japan

[73] Assignee: Kabushiki Kaisha Toshiba, Kawasaki, Japan

[21] Appl. No.: 08/788,695

[22] Filed: Jan. 24, 1997

[30] Foreign Application Priority Data

Jan. 25, 1996 [JP] Japan ..... 8-011033

[51] Int. Cl.[6] ..... H01J 1/30

[52] U.S. Cl. ..... 313/309; 438/20; 445/24; 445/50; 313/311

[58] Field of Search ..... 445/24, 50; 438/20; 313/309, 311; 257/10

[56] References Cited

U.S. PATENT DOCUMENTS

| | | | |
|---|---|---|---|
| 3,970,887 | 7/1976 | Smith et al. | 257/10 X |
| 5,358,908 | 10/1994 | Reinberg et al. | 438/20 |
| 5,420,054 | 5/1995 | Choi et al. | 438/20 |
| 5,483,118 | 1/1996 | Nakamoto et al. . | |
| 5,499,938 | 3/1996 | Nakamoto et al. . | |

OTHER PUBLICATIONS

J. Vac. Sci. Technol. B 14(3), May/Jun. 1996, pp. 1906–1909, Donghwan Kim, et al. "Fabrication of Silicon Field Emitters by Forming Porous Silicon".

*Primary Examiner*—Kenneth J. Ramsey
*Attorney, Agent, or Firm*—Oblon, Spivak, McClelland, Maier & Neustadt, P.C.

[57] ABSTRACT

A field emission type cold cathode apparatus comprises a mother material layer made of an n-type silicon layer, a conical emitter having an arcuate side surface, an insulating layer formed in a surface region of the mother material layer in a manner to define the arcuate side surface of the emitter and having a concave portion formed to expose the tip portion of the conical emitter, the depth of the concave portion being determined such that the lower portion of the emitter covering a region more than half the height of the emitter is buried in the insulating layer, and a gate electrode formed over the insulating film in a manner to surround the emitter and having an open portion exposing the tip portion of the emitter, the diameter of the open portion being smaller than the diameter in the base portion of the emitter.

28 Claims, 6 Drawing Sheets

FIELD EMISSION TYPE COLD CATHODE APPARATUS AND METHOD OF MANUFACTURING THE SAME

BACKGROUND OF THE INVENTION

The present invention relates to a field emission type cold cathode apparatus and a method of manufacturing the same.

Various possibilities are expected in a field emission type vacuum micro apparatus. For example, it may be possible to achieve a high speed response. It may also be possible to achieve improvements in resistances to radiations and to high temperatures. Further, it may be possible to achieve a self-light emitting type display device of a high precision. Under the circumstances, vigorous studies are being made in recent years on the field emission type vacuum micro apparatus. The study on the particular apparatus was motivated by a proposal on a tunnel effect vacuum triode.

However, it is a report on a cold cathode apparatus using a thin film that has caused the attentions in this technical field to be paid to the particular apparatus. A clever technique utilizing a rotary oblique vacuum vapor deposition method and an etching of a sacrificial layer is proposed in the report. To be more specific, a manufacturing method of a device, which is called a Spindt type and most widely employed nowadays, and the basic construction of the device are proposed in the report. FIGS. 1A to 1D collectively show the basic technical idea of the particular method.

As shown in the drawings, a thermal oxide film 82 is formed first on a silicon substrate 81, followed by forming a metal layer 83 made of a metal used for forming a gate electrode, e.g., molybdenum, on the thermal oxide film 82. Then, the metal layer 83 is patterned to form an opening for a gate electrode, followed by etching the oxide film 82 to form a hole 84, as shown in FIG. 1A. In the next step, a sacrificial metal, e.g., aluminum, is deposited on the metal layer 83 to form a thin sacrificial layer 85, as shown in FIG. 1B.

After formation of the sacrificial layer 85, a metal for forming an emitter, e.g., molybdenum, is formed by a rotary oblique vapor deposition method to form a metal layer 86, as shown in FIG. 1C. In this step, the metal forming the metal layer 86 is also deposited within the hole 84, with the result that the open portion of the hole 84 is gradually diminished. It follows that a molybdenum emitter 87 having a conical tip portion is formed within the hole 84. Finally, the sacrificial layer 85 is removed together with the metal layer 86 positioned on the gate electrode 83 so as to prepare a cold cathode apparatus, as shown in FIG. 1D. In this technique, however, the emitter material is limited to a material which can be used in a vapor deposition method, with the result that a nonuniformity of the element characteristics which is derived from a nonuniformity of the material tends to take place easily.

Also proposed is a technique of forming an emitter using a silicon single crystal having a high purity and good reproducibility, which is shown in FIGS. 2A to 2G.

Specifically, a silicon oxide film 92 is formed first by thermally oxidizing a surface region of a silicon substrate 91, as shown in FIG. 2A, followed by patterning the silicon oxide film 92 to form a mask 93, as shown in FIG. 2B. Then, the silicon substrate 91 is subjected to an isotropic etching using the silicon oxide mask 93, with the result that those portions of the silicon substrate 91 which are positioned below the end portions of the mask 93 are removed because of the side etching, as shown in FIG. 2C. Further, the silicon substrate 91 is subjected to an additional thermal oxidation to form a silicon oxide film 94. In this step, the narrow tip portion, which is in direct contact with the mask 93, of the silicon substrate 91 is also oxidized thermally, with the result that the silicon substrate 91 is allowed to have a sharp tip portion below the mask 93, as shown in FIG. 2D. In the next step, a gate insulating film 95 consisting of, for example, a silicon dioxide film is deposited on the entire surface with the mask 93 left unremoved, followed by forming a metal layer 96 consisting of a metal used for forming a gate electrode, e.g., molybdenum, as shown in FIG. 2E. Finally, the silicon oxide films 92 and 94 are removed by etching so as to lift off the mask 93, thereby forming a silicon emitter 97 in the center of the open portion for the gate electrode, as shown FIGS. 2F and 2G.

The conventional method shown in FIGS. 2A to 2G is excellent in that a silicon single crystal which is stable and exhibits a good reproducibility is used as a starting material, and that an emitter can be formed by self-alignment relative to a gate electrode. However, serious problems given below must be solved in putting the particular method to practical use. First of all, it is difficult to control the etching direction and rate as desired in forming the emitter by the isotropic etching of the silicon substrate. In addition, it is very difficult to form the emitter of a desired shape with a satisfactory reproducibility because the end point of the isotropic etching cannot be determined accurately. Alternatively, it is also proposed to employ an anisotropic etching of a silicon substrate for forming the emitter. However, similar problems are left unsolved in this alternative technique. Particularly, if the side etching below the oxide mask is performed to make the resultant silicon region right under the mask as thin as possible by either the isotropic etching or anisotropic etching in an attempt to form a sharply pointed emitter, the mask is likely to be collapsed. In this case, it is impossible to carry out the subsequent steps for forming the gate insulating film 95 and the gate electrode 96, quite naturally.

What should also be noted is that, in the conventional method shown in FIGS. 2A to 2G, it is necessary to form the gate insulating film 95 by a deposition method such as a sputtering or CVD method in order to ensure a sufficient height of the gate insulating film 95. Therefore, it is difficult to obtain a sufficient gate withstand voltage. Further, the open portion of the gate electrode is determined by the pattern of the mask 93, making it impossible to diminish the distance between the emitter and the gate electrode.

Incidentally, it is also known to the art that a metal layer is formed by vapor deposition in an obliquely downward direction after the step shown in FIG. 2D, followed by lifting off the mask 93. However, problems similar to those described above are also left unsolved in this method.

BRIEF SUMMARY OF THE INVENTION

An object of the present invention is to provide a field emission type cold cathode apparatus and a method of manufacturing the same. In the present invention, a homogeneous silicon substrate which is stable and exhibits a good reproducibility is used as a starting material so as to improve the reproducibility in the shape of an emitter and to achieve a uniform emitter. Further, the present invention permits achieving higher gate insulating properties, and a good arrangement of a gate electrode and an emitter.

According to a first aspect of the present invention, there is provided a field emission type cold cathode apparatus, comprising a mother material layer made of an n-type silicon layer; a conical emitter having an arcuate side surface; an insulating layer formed in a surface region of the mother material layer in a manner to define the arcuate side surface of the emitter and having a concave portion formed to expose the tip portion of the conical emitter, the insulating layer comprising a silicon oxide layer formed by thermally oxidization of silicon which contains a p-type impurity in an amount larger than an amount of an n-type impurity; and a gate electrode formed over the insulating film in a manner to surround the emitter and having an open portion exposing the tip portion of the emitter.

In the apparatus of the first aspect, it is desirable for the emitter to constitute a part of the mother material layer. Also, it is desirable for the insulating layer included in the apparatus of the first aspect to the depth of the concave portion is determined such that the lower portion of the emitter covering a region more than half the height of the emitter is buried in the insulating layer, and the diameter of the open portion is smaller than the diameter in the base portion of the emitter. Further, it is desirable for the diameter of the open portion of the gate electrode to be a half or less of the diameter at the base portion of the emitter.

According to a second aspect of the present invention, there is provided a field emission type cold cathode apparatus, in which the emitter is made of an electrically conductive material differing from the material of the mother material layer. It is desirable for the emitter included in the apparatus of the second aspect to be formed of one of a low work function and negative electron affinity material.

According to a third aspect of the present invention, there is provided a field emission type cold cathode apparatus, in which the gate electrode consists of an $n^+$-type silicon layer formed in a surface region of the mother material layer.

According to a fourth aspect of the present invention, there is provided a field emission type cold cathode apparatus, in which the emitter included in the apparatus of any of the first to fourth aspects of the present invention comprises a core portion made of an n-type silicon region and a p-type diffusion layer formed in a surface region of the core portion.

According to a fifth aspect of the present invention, there is provided a method of manufacturing a field emission type cold cathode apparatus according to any of the first to fourth aspects, comprising the steps of forming a p-type region in a surface region of the mother material layer; forming a porous layer by applying an anodic forming to the p-type region; and forming the insulating layer by thermally oxidizing the porous layer.

As described above, a p-type impurity is selectively diffused into a surface region of an n-type silicon substrate in the present invention. In this step, the profile of the impurity diffusion is controlled to form a p-type region such that the n-type region surrounded by the p-type region is made gradually smaller toward the substrate surface. Then, the p-type region around the n-type region is selectively made porous by application of an anodic forming within a hydrofluoric acid or photo-forming, followed by thermally oxidizing the porous layer to form a thermal silicon oxide layer. Further, the thermal silicon oxide layer is selectively removed by etching so as to leave an n-type silicon emitter unremoved and, at the same time, to form a thermal silicon oxide gate insulating film surrounding the n-type silicon emitter.

The method of the present invention for manufacturing a field emission type cold cathode apparatus further comprises the steps of selectively removing the thermal silicon oxide layer to expose the sharp tip portion of the emitter, followed by plating the tip portion of the emitter with a metal; and lifting off the gate metal layer with the plated metal used as a sacrificial layer. The particular technique permits determining the position of the gate electrode by self-alignment in the vicinity of the emitter.

In the method of the present invention for manufacturing a field emission type cold cathode apparatus, the step of forming the porous layer includes formation of an n-type region within the p-type region. Where the n-type region is formed within the p-type region, a non-oxidized $n^+$ region is selectively left unremoved in the surface region of the thermal silicon oxide layer. The particular technique permits simultaneously forming a gate electrode layer by self-alignment.

The method of the present invention for manufacturing a field emission type cold cathode apparatus further comprises the steps of selectively etching the mother material layer except the porous layer; loading a material differing from the material of the mother material layer in the porous layer acting as a mold; and exposing the material differing from the material of the mother material layer. The particular technique makes it possible to obtain an emitter made of a material other than silicon together with a gate insulating film and a gate electrode.

An isotropic etching, which is nonuniform in its etching rate, is employed in the conventional technique, in forming an emitter, leading to a poor reproducibility of the emitter. In the present invention, however, the isotropic etching is not employed for forming the emitter, making it possible to form the emitter with a high controllability. Also, the present invention is free from the peeling of the mask caused by an over-etching and the problems accompanying the peeling of the mask. To be more specific, the shape of the n-type region which is left unremoved for use as an emitter is controlled by the profile of a p-n junction formed by impurity diffusion. What should be noted is that the p-n junction profile can be controlled by the steps excellent in reproducibility, i.e., an ion implantation and diffusion within a solid material, making it possible to form an emitter with a prominently high reproducibility compared with the conventional technique. Also, the final profile can be checked before the step of the anodic forming. Further, the step of the anodic forming can be performed after a fine adjustment of the diffusion, if necessary. Still further, since the anodic forming is automatically stopped in accordance with a predetermined p-n junction profile, it is unnecessary to employ the troublesome conventional method, which is poor in reproducibility, that a fine adjustment must be performed during the etching treatment.

It should also be noted is that a thermal oxide insulating layer is formed closely to an emitter in a manner to surround the emitter in the present invention such that the insulating layer has a sufficient height equal to or larger than the height of the emitter, making it possible to use the insulating layer for forming a gate electrode positioned sufficiently close to the tip portion of the emitter. Also, since the insulating layer consists of a thermal oxide film of a single layer structure unlike a film formed by deposition such as a CVD film, the insulating layer exhibits excellent insulating properties and stability. Further, since the emitter and the gate insulating film are formed in a single silicon layer used as a starting material, the interface between the emitter and gate insulating film is aligned in a level of atoms. In other words, an interface as in a bonded structure or laminate structure is not formed in the present invention between the emitter and the gate insulating film, with the result that leakage or creeping discharge is unlikely to take place in the present invention.

What should also be noted is that, in the present invention, an emitter is formed in a manner to be buried in a thermal silicon oxide film, making it possible to form a gate electrode positioned so close to an emitter as not to be formed in the conventional technique. In addition, the height of the gate electrode can be made equal to that of the sharp tip portion of the emitter. Further, the emitter can be supported up to a required height by a gate insulating film. Still further, since the gate insulating film has a substantially planar surface in the present invention unlike the prior art shown in FIGS. 2A to 2G, the gate insulating film is adapted for the patterning of a gate electrode and for formation of a laminate structure including an anode, etc.

An additional feature to be noted is that not only an emitter and a gate insulating film but also a gate electrode layer can be formed simultaneously by self-alignment by selectively leaving an n-type region within a p-type region. The particular technique makes it possible to employ a silicon process in any of all the steps using a single mask for manufacturing a cold cathode apparatus integrated with a gate with a good reproducibility.

As described above, a silicon substrate, which is homogeneous, excellent in reproducibility and stable, is used as a starting material in the present invention so as to improve the reproducibility of the shape of an emitter, making it possible to form uniform emitters. Also, the present invention permits achieving sufficiently high gate insulating properties and a satisfactory arrangement of a gate electrode and an emitter.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

Figure 1A:
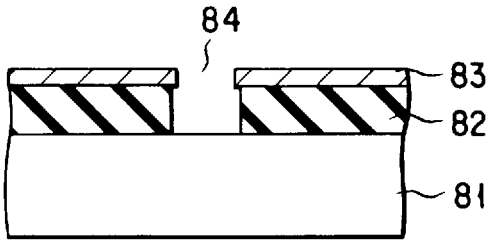
FIG. 1A (PRIOR ART)
FIGS. 1A to 1D are cross sectional views collectively showing a conventional method of manufacturing a field emission type cold cathode apparatus.
Figure 1B:
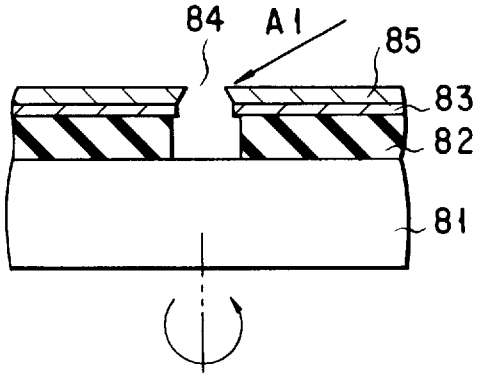
FIG. 1B (PRIOR ART)
Figure 1C:
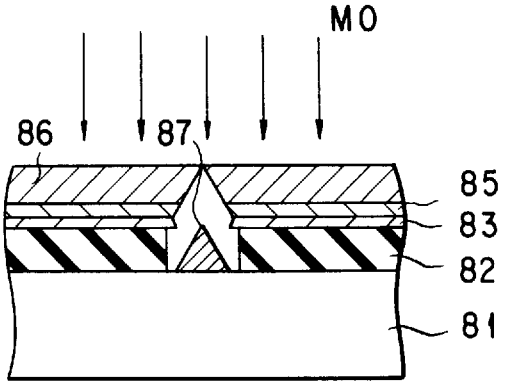
FIG. 1C (PRIOR ART)
Figure 1D:
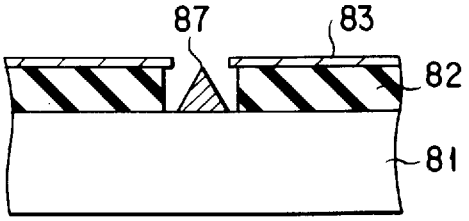
FIG. 1D (PRIOR ART)
Figure 2A:
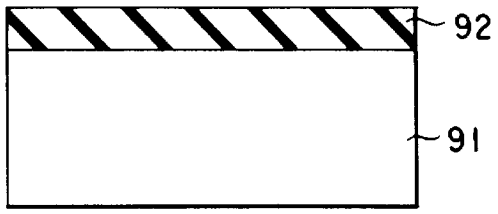
FIG. 2A (PRIOR ART)
FIGS. 2A to 2G are cross sectional views collectively showing another conventional method of manufacturing a field emission type cold cathode apparatus.
Figure 2B:
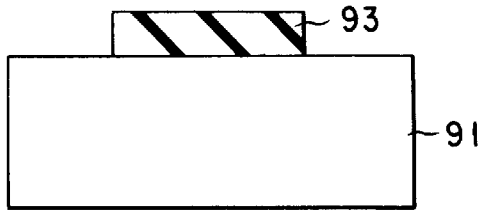
FIG. 2B (PRIOR ART)
Figure 2C:
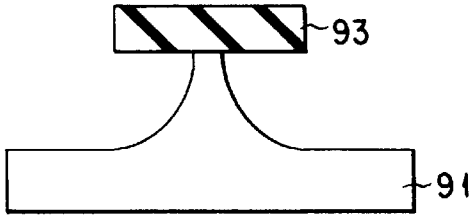
FIG. 2C (PRIOR ART)
Figure 2D:
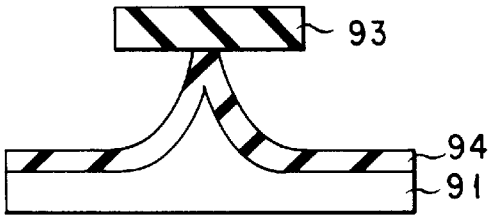
FIG. 2D (PRIOR ART)
Figure 2E:
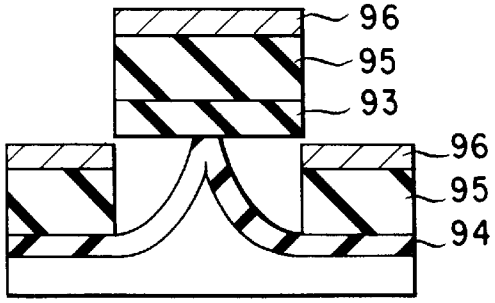
FIG. 2E (PRIOR ART)
Figure 2F:
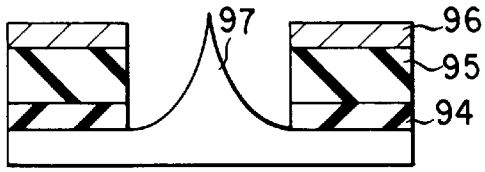
FIG. 2F (PRIOR ART)
Figure 2G:
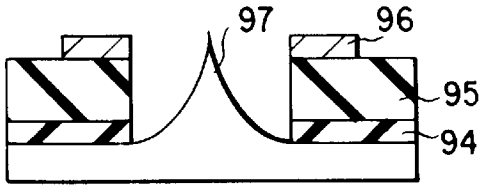
FIG. 2G (PRIOR ART)
Figure 3:
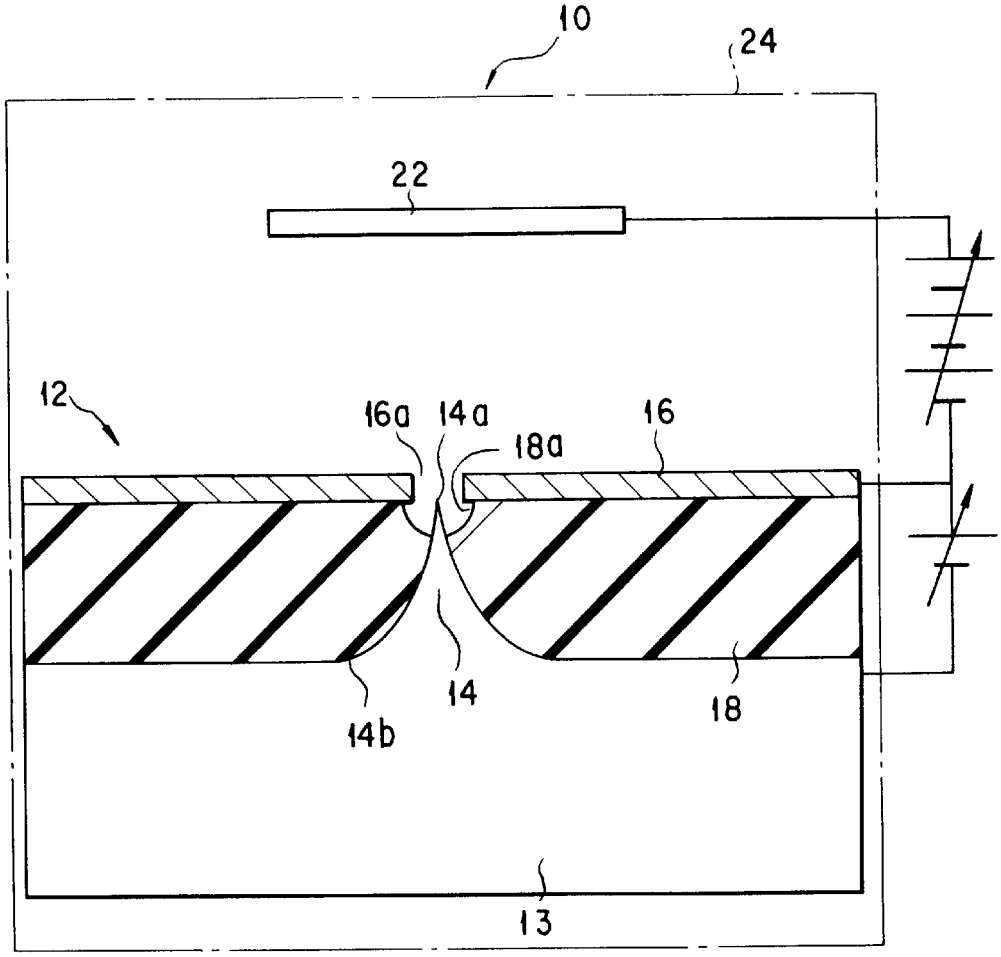
FIG. 3 is a cross sectional view schematically showing a vacuum micro apparatus using a field emission type cold cathode apparatus according to a first embodiment of the present invention.

Let us describe in detail some embodiments of the present invention with reference to the accompanying drawings. Specifically, FIG. 3 schematically shows a vacuum micro apparatus 10 using a field emission type cold cathode apparatus 12 according to a first embodiment of the present invention. As shown in the drawing, the apparatus 12 comprises a conical emitter 14 which emits electrons in the form of field emission and a gate electrode 16 serving to control the field emission and insulated from the emitter 14 with an insulating layer 18. As described later, the insulating layer 18 consists of a silicon oxide layer prepared by applying an anodic forming to a p-type diffusion layer formed in a surface region of an n-type silicon substrate 13, i.e., a mother material layer, to make the p-type diffusion layer porous, followed by thermally oxidizing the porous layer.

The conical emitter 14 having a sharp tip portion, which is surrounded by the insulating layer 18, consists of a non-modified region of the n-type silicon substrate 13. Naturally, the base portion 14*b* of the emitter 14 is substantially flush with the base portion of the insulating layer 18 within the n-type silicon substrate 13. The lower portion of the emitter 14, which is more than half the height of the emitter 14, is buried in the insulating layer 18. It should be noted that the side surface of the emitter 14 is shaped arcuate, the arcuate side surface being derived from the shape of the inner edge portion of the insulating layer 18.

It is seen that an open portion 16*a* is formed in the gate electrode 16, with a concave portion 18*a* being formed in the insulating layer 18. As a result, a tip portion 14*a* of the emitter 14 is exposed to the outside. The diameter of the open portion 16*a* should be smaller than the diameter in the base portion 14*b* of the emitter 14. Preferably, the diameter of the open portion 16*a* should be less than half the diameter of the base portion 14*b*.

The vacuum micro apparatus 10 comprises an anode 22 arranged to face the emitter 14. In general, the cold cathode apparatus 10 and the anode 22 are housed in a vacuum vessel 24 to set up vacuum in the region between the emitter 14 and the anode 22. In order to allow the emitter 14 to emit electrons, a negative potential is applied to the emitter 14 relative to the anode 22. On the other hand, a potential intermediate between the emitter potential and the anode potential is applied to the gate electrode 16.

Figure 4A:
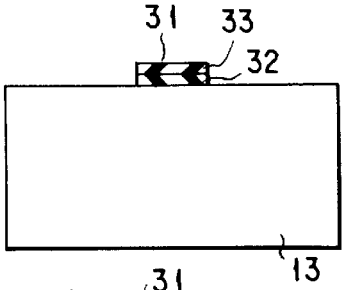
FIGS. 4A to 4K are cross sectional views collectively showing a method of manufacturing the field emission type cold cathode apparatus shown in FIG. 3.

FIGS. 4A to 4K are cross sectional views collectively showing how to manufacture the field emission type cold cathode apparatus 12 shown in FIG. 3. In the first step, a silicon oxide film 32 is formed by thermal oxidation on an n-type silicon substrate 13, i.e., mother material layer, by a known method. Then, a silicon nitride ($Si_3N_4$) film 33 is formed on the silicon oxide film 32 by a CVD method, followed by patterning the resultant laminate structure consisting of the oxide film 32 and the nitride film 33 to form a mask 31, as shown in FIG. 4A. In this embodiment, the mask 31 is circular and has a diameter of 3 $\mu$m.

Figure 4B:
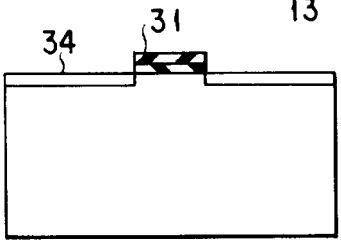

After formation of the mask 31, a boron diffusion source layer 34 is formed by ion implantation in a surface region of the silicon substrate 13, as shown in FIG. 4B. In this embodiment, the boron ions are implanted with a dose of $1\times10^{14}$ $cm^{-2}$.

Figure 4C:
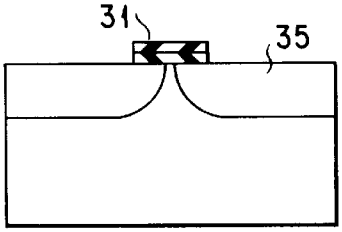

In the next step, the substrate is annealed to permit the boron atoms within the diffusion source layer 34 to be diffused so as to form a p-type diffusion layer 35, as shown in FIG. 4C. In this annealing step, the p-n junction is extended to both downward and sideward, i.e., toward a region below the mask 31, within the silicon substrate 13. It follows that an undoped region of the n-type silicon substrate 13 can be made to gradually diminish toward the center of the mask 31 by controlling the boron diffusion time.

Figure 4D:
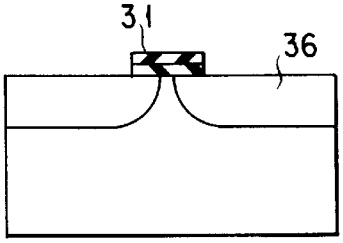

Further, an anodic forming is applied selectively to the p-type diffusion layer 35 so as to form a porous p-type silicon layer 36, as shown in FIG. 4D. The anodic forming is performed within a mixed solution of hydrofluoric acid and ethanol by applying a voltage between an anode connected to the p-type diffusion layer 35 and a cathode made of platinum, etc. Alternatively, irradiation of the mixed solution with light may be employed in place of the voltage application. Specifically, the light irradiation induces a self-electrolytic reaction across the p-n junction so as to permit the p-type region to be selectively subjected to an anodic forming. In this case, the reaction which actually takes place is based on a principle similar to that of the anodic forming. Therefore, the anodic forming employed in the present invention includes the treatment utilizing the light irradiation. In employing the treatment utilizing the light irradiation, it is desirable to allow the n-type region to be exposed partly to the surface by using another mask so as to carry out smoothly the photo-forming at the p-n junction. For allowing the n-type region to be exposed to the surface, it is desirable to remove the mask 31 before the photo-forming step.

Figure 4E:
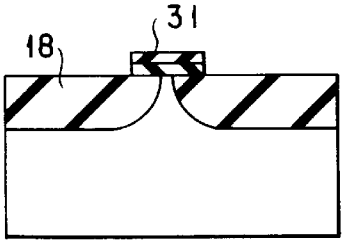
Figure 4F:
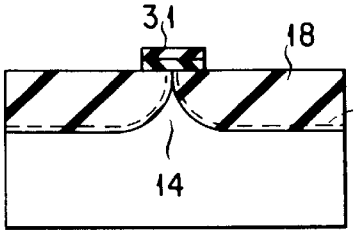

In the next step, the substrate 13 having the porous p-type silicon layer 36 is subjected to a thermal oxidation so as to convert the porous layer 36 into an insulating layer 18 consisting of the thermally oxidized silicon, as shown in FIG. 4E. It is desirable to perform an additional thermal oxidation treatment to oxidize the interface of the n-type region of the silicon substrate 13 so as to form an insulating layer 37, as shown in FIG. 4F. As apparent from the drawing, the presence of the insulating layer 37 permits further sharpening the tip portion of an emitter 14. Of course, it is also possible to control the impurity diffusion profile in a manner to obtain a sharp tip portion of the emitter 14 without employing the additional thermal oxidation treatment. In this fashion, the emitter 14 consisting of the n-type silicon is formed in a manner to be buried in the satisfactory insulating layer 18 formed by the thermal oxidation treatment.

Figure 4G:
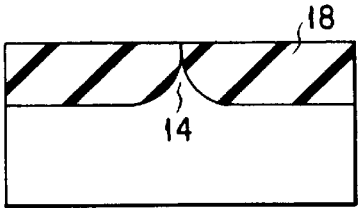

After formation of the emitter 14, the mask 31 is removed, followed by slightly etching, if necessary, the insulating layer 18 until the tip of the emitter 14 is exposed to the surface, as shown in FIG. 4G. An electrode used in the subsequent plating step can also be used in this exposing step to check whether the emitter 14 can be electrically connected to the electrode through a mixed solution used in the subsequent plating step. To be more specific, the emitter 14 is not electrically connected to the electrode through the mixed solution while the tip of the emitter 18 is covered with the insulating layer 18. However, the electrical connection can be achieved when the etching of the insulating layer 18 has proceeded to expose the tip of the emitter 14. Naturally, the etching is stopped when the electrical connection has been achieved.

Figure 4H:
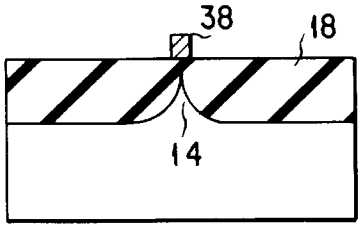

After the tip of the emitter 14 has been exposed to the surface, a sacrificial metal layer 38 is formed on the tip of the emitter 14 by means of an electrolytic plating, as shown in FIG. 4H. In this embodiment, the sacrificial metal layer 38 consists of copper.

Figure 4I:
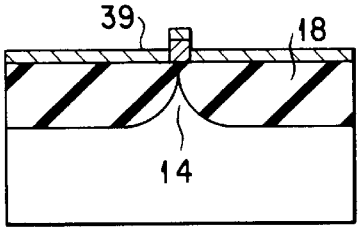
Figure 4J:
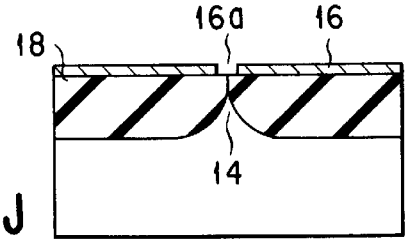
Figure 4K:
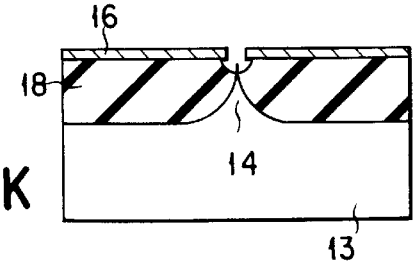

Then, a gate metal layer 39 is formed by a thin film-forming process such as a vapor deposition, as shown in FIG. 4I. In this embodiment, the gate metal layer 39 is formed by depositing molybdenum in a thickness of 200 nm by means of an electron beam vapor deposition method. Further, the sacrificial metal layer 38 having molybdenum deposited thereon in the previous step of forming the gate metal layer 39 is etched. In this step, the molybdenum layer deposited on the layer 38 is lifted off, thereby forming a gate electrode 16 having an open portion 16*a*, as shown in FIG. 4J. Further, a concave portion 18a is formed in the insulating layer 18 by etching through the open portion 16*a* of the gate electrode 16, as shown in FIG. 4K. In this embodiment, the etching depth of the concave portion 18*a* is less than half the height as measured from the base portion 14*b* to the tip 14*a* of the emitter 14 shown in FIG. 3. As a result, the base portion of the emitter 14 is covered substantially completely with the insulating layer 18, leading to a further diminished substantial size of the emitter 14.

FIGS. 5A to 5F collectively show a method of manufacturing a field emission type cold cathode apparatus according to a second embodiment of the present invention. In this embodiment, the gate electrode can also be formed by self-alignment together with the emitter and the gate insulating film by the steps of impurity diffusion, anodic forming and thermal oxidation.

Figure 5A:
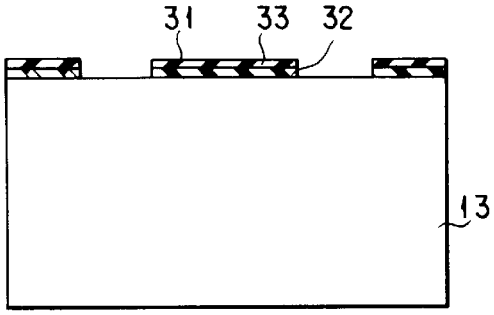
FIGS. 5A to 5F are cross sectional views collectively showing a method of manufacturing a field emission type cold cathode apparatus according to a second embodiment of the present invention.
Figure 5B:
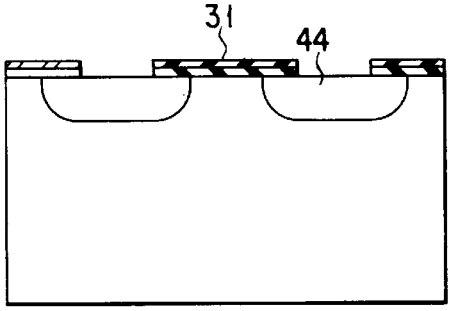
Figure 5C:
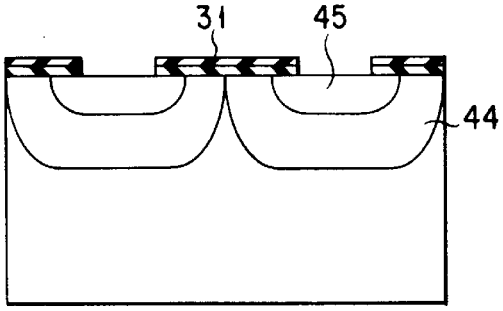

In the first step, the mask 31 of a laminate structure consisting of the thermally oxidized silicon film 32 and the CVD $Si_3N_4$ film 33 is formed on the mother material layer, i.e., the n-type silicon substrate 13, as shown in FIG. 5A. Then, boron ions are implanted into a surface region of the silicon substrate 13 by using the mask 31, followed by an annealing treatment to form p-type diffusion layers 44, as shown in FIG. 5B. Further, phosphorus is diffused into a surface region of the p-type diffusion layer 44 by using the mask 31 so as to form an $n^+$-type diffusion layer 45 of a low resistivity. It should be noted that, in the annealing step for the phosphorus diffusion, the p-type diffusion layers 44 are expanded both downward and sideward such that the edges of the two adjacent diffusion layers 44 are positioned close to each other or joined together below the mask 31, with the result that the non-doped region of the n-type silicon substrate 13 is shaped like an emitter below the mask 31. At the same time, the $n^+$-type diffusion layer 45 is formed in the retreated position within the p-type diffusion layer 44, as shown in FIG. 5C. Incidentally, the particular diffusion profile can be controlled by the technique generally employed in the manufacture of a bipolar transistor or IC.

Figure 5D:
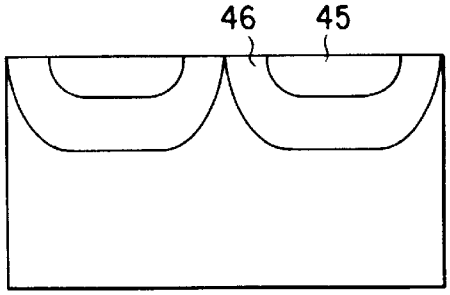

In the next step, the p-type diffusion layers 44 alone are selectively subjected to an anodic forming to form porous silicon layers 46, as shown in FIG. 5D. In this anodic forming step, the p-type diffusion layer 44 may be connected to a power source, or a photo-forming may be employed without using a power source, as in the embodiment shown in FIG. 4.

Figure 5E:
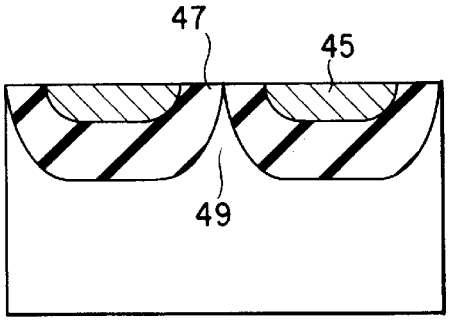
Figure 5F:
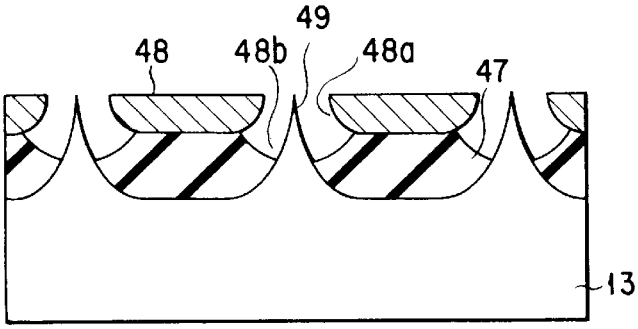

Then, the resultant porous silicon layers 46 are thermally oxidized to form insulating layers 47 consisting of silicon oxide, as shown in FIG. 5E, followed by etching appropriately the insulating layers 47 to form an open portion 48*a* of a gate electrode 48 and a concave portion 48*b* of the insulating layer 47, as shown in FIG. 5F. As apparent from the drawing, the gate electrode 48 consisting of the $n^+$-type silicon layer of a low resistivity is insulated from the emitter 49 consisting of the n-type silicon layer by the insulating layers 47 each formed of the thermally oxidized silicon. What should be noted is that these constituents of the cold cathode apparatus are formed by self-alignment.

In the embodiment shown in FIG. 5, the lower portion, covering more than half the height of the emitter 49, of the emitter 49 is buried in the insulating layer 47, as in the embodiment shown in FIG. 4. Also, the side surface of the emitter 49 is shaped arcuate, the arcuate side surface being derived from the shape of the inner edge portion of the insulating layer 47. Further, the diameter of the open portion 48*a* should be smaller than that of the base portion of the emitter 49. Preferably, the diameter of the open portion 48*a* should be less than half the diameter of the base portion of the emitter 49.

Figure 6:
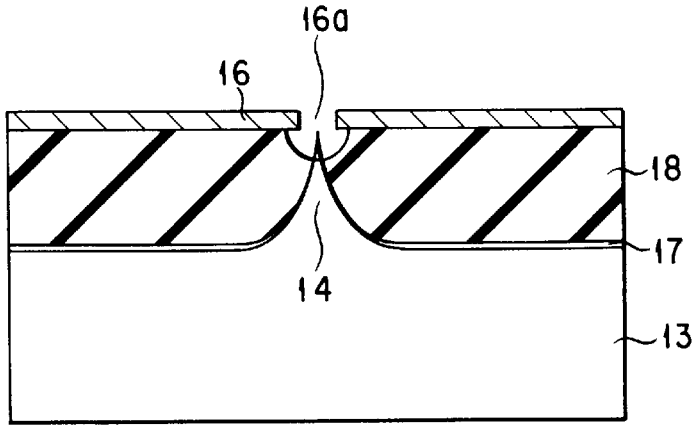
FIG. 6 is a cross sectional view showing the construction of a field emission type cold cathode apparatus according to a third embodiment of the present invention.

An n-type silicon substrate is used in each of the first and second embodiments described above. Alternatively, it is possible to use a substrate including an $n^+$-type lower layer and an n-type upper layer, as shown in FIG. 6. With this configuration, a resistance between a rear surface contact portion and a tip of the emitter can be reduced, thereby flowing out of a large current can be suppressed.

Specifically, FIG. 6 is a cross sectional view showing a field emission type cold cathode apparatus according to a third embodiment of the present invention this embodiment is featured in that the emitter is of p-n junction type.

In this embodiment, a porous silicon layer is formed in the n-type silicon substrate 13 to surround an emitter by the method described previously. Then, the porous silicon layer is doped with a high concentration of a p-type impurity, e.g., boron, followed by thermally oxidizing the doped porous silicon layer. In the step of the thermal oxidation, boron is diffused from the doped oxide layer 18 into a surface region of the n-type silicon emitter layer 14 so as to form a p-type diffusion layer 17 in the surface region of the emitter 14. It follows that the emitter 14 includes a p-n junction formed between the n-type silicon core portion and the p-type diffusion layer 17 in the surface region of the emitter 14.

FIGS. 7A to 7D collectively show a method of manufacturing a field emission type cold cathode apparatus according to a fourth embodiment of the present invention. This embodiment is featured in that the emitter material differs from the substrate material.

Figure 7A:
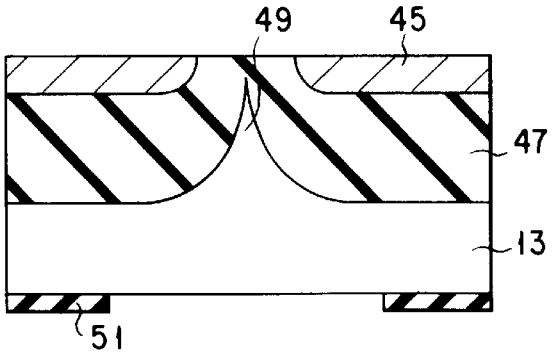
FIGS. 7A to 7D are cross sectional views collectively showing a method of manufacturing a field emission type cold cathode apparatus according to a fourth embodiment of the present invention.

In this embodiment, the n-type diffusion layer 45 and the insulating layer 47 consisting of a thermally oxidized porous silicon layer are formed in a surface region of an n-type silicon substrate 13 by the steps shown in FIGS. 5A to 5E. Then, a mask 51 consisting of a thermally oxidized silicon layer is formed on the back surface of the silicon substrate 13, as shown in FIG. 7A. The mask 51 is positioned to allow an open portion 52 to correspond to the emitter 49. Incidentally, it is not absolutely necessary for the open portion 52 of the mask 51 to be separated for each of the emitters. In other words, the open portion 52 may be formed to cover a plurality of emitters as far as the mechanical strength of the substrate 13 can be ensured.

Figure 7B:
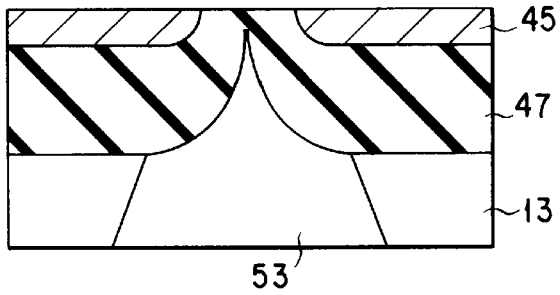
Figure 7C:
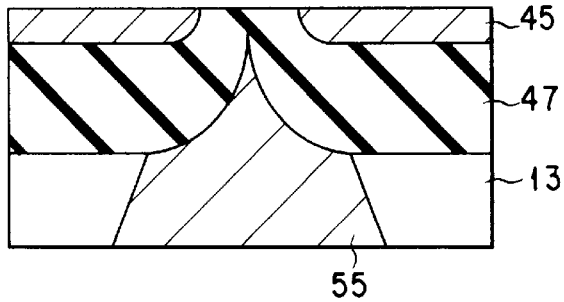
Figure 7D:
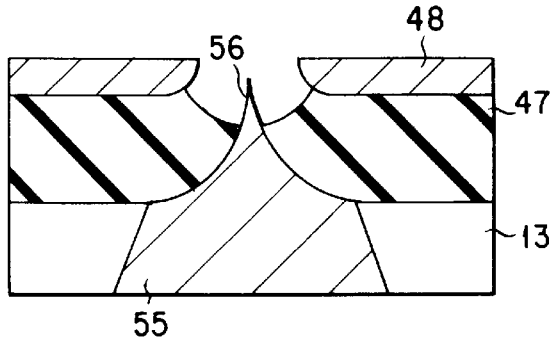

In the next step, the substrate 13 is selectively etched through the open portion 52 of the mask 51 to form a hole 53, as shown in FIG. 7B, followed by depositing an emitter material on the insulating layer 47 to form an emitter material layer 55 within the hole 53, as shown in FIG. 7C. The emitter material can be selected optionally from among various materials including metals having a high melting point such as molybdenum and tantalum, and materials having a low work function such as SiC, $LaB_6$, TiN, and materials having negative electron affinity such as diamond and GaN. After formation of the emitter material layer 55, the insulating layer 47 on the front surface of the silicon substrate 13 is etched appropriately so as to expose the emitter region to the outside, thereby to form a cold cathode apparatus having an emitter 56 made of a material differing from the substrate material, as shown in FIG. 7D.

Incidentally, the technical idea of the fourth embodiment shown in FIG. 7 can also be applied to the first and second embodiments described previously.

As apparent from the embodiments described above, the process of impurity diffusion is employed in the present invention for controlling the shape of the emitter tip portion. The particular process is markedly advantageous over the conventional technique of a wet etching or the like in the capability of controlling the shape of the emitter tip portion. In addition, the diffusion profile can be checked before the anodic forming step corresponding to the conventional etching process, making a fine adjustment possible. In other words, an over-etching can be prevented, leading to an improved yield. This is a prominent merit compared with the conventional method utilizing a wet etching. To be more specific, the wet etching tends to proceed excessively in the conventional method so as to peel off the mask or break the tip portion of the emitter, leading to a low yield.

In the present invention, an over-etching is unlikely to take place, as pointed out above. In addition, the porous silicon layer after the anodic forming retains its original shape, with the result that the emitter is protected satisfactorily and, thus, is unlikely to be broken. Further, the emitter is surrounded completely by the silicon oxide layer after the thermal oxidation step and, thus, is protected sufficiently.

What should also be noted is that, in the conventional method, the insulating layer extends to reach only the base portion of the emitter, with a free space provided between the side surface of the emitter and the edge of the insulating layer. Alternatively, the insulating layer is formed to extend along the side surface of the emitter. In this case, however, the insulating layer fails to reach the tip portion of the emitter. In the present invention, however, the insulating layer is formed in contact with the emitter. In addition, the upper surface of the insulating layer can be made flush with the tip of the emitter, leading to a higher degree of freedom in the arrangement of the emitter and the gate, compared with the conventional method. For example, the emitter and the gate can be arranged highly close to each other such that the tip of the emitter is flush with the gate electrode, as in the embodiments shown in the drawings. Of course, it is also possible to etch deeply the gate insulating film, if necessary, to arrange the gate electrode in a position lower than the tip of the emitter.

What should also be noted is that the gate insulating film of a single layer structure, which consists of thermally oxidized silicon, is formed on a surface of the substrate including the emitter region such that the gate insulating film has a planar surface. The particular construction facilitates the patterning of the gate electrode and is advantageous for integrally laminating an anode on the substrate. Further, the gate insulating film can be etched in optional depth and width in the open portion of the gate electrode. It follows that the present invention permits providing a cold cathode apparatus which includes a gate insulating film of a single layer structure consisting of thermally oxidized silicon and positioned at a height substantially flush with the tip of the emitter. In addition, the diameter of the open portion of the gate electrode can be made smaller than that of the base portion of the emitter. This implies that a sufficient mechanical strength of the emitter can be ensured, and that it is possible to obtain a diameter in the open portion of the gate electrode and a distance between the gate and the emitter, which are substantially smaller than the mask size defined in the photolithography. The particular construction is effective for achieving a higher concentration of the electric field. Materials other than silicon can also be used in the present invention. Specifically, a material having a low work function or the like, which is adapted for forming an emitter, can be optionally selected in the present invention.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

We claim:

1. A field emission type cold cathode apparatus, comprising:

a mother material layer made of an n-type silicon layer;

a conical emitter having an arcuate side surface;

an insulating layer formed in a surface region of the mother material layer in a manner to define the arcuate side surface of the emitter and having a concave portion formed to expose the tip portion of the conical emitter, said insulating layer comprising a silicon oxide layer formed by thermally oxidization of silicon which contains a p-type impurity in an amount larger than an amount of an n-type impurity; and a gate electrode formed over the insulating film in a manner to surround the emitter and having an open portion exposing the tip portion of the emitter.

2. The field emission type cold cathode apparatus according to any one of claim 1, wherein said gate electrode consists of an $n^+$-type silicon layer formed in a surface region of the mother material layer.

3. A method of manufacturing a field emission type cold cathode apparatus according to any one of claim 1, comprising the steps of:

forming a p-type region in a surface region of the mother material layer;

forming a porous layer by applying an anodic forming to said p-type region; and forming the insulating layer by thermally oxidizing said porous layer.

4. The method of manufacturing a field emission type cold cathode apparatus according to claim 3, further comprising the steps of:

selectively removing the thermal silicon oxide layer to expose the sharp tip portion of the emitter, followed by plating the tip portion of the emitter with a metal; and lifting off the gate metal layer with said plated metal used as a sacrificial layer.

5. The method of manufacturing a field emission type cold cathode apparatus according to claim 3, wherein said step of forming said porous layer includes formation of an n-type region within said p-type region.

6. The method of manufacturing a field emission type cold cathode apparatus according to claim 3, further comprising the steps of:

selectively etching the mother material layer except the porous layer;

loading a material differing from the material of the mother material layer in the porous layer acting as a mold; and exposing the material differing from the material of said mother material layer to the outside.

7. The field emission type cold cathode apparatus according to claim 1, wherein said emitter constitutes a part of the mother material layer.

8. A method of manufacturing a field emission type cold cathode apparatus according to any one of claim 7, comprising the steps of:

forming a p-type region in a surface region of the mother material layer;

forming a porous layer by applying an anodic forming to said p-type region; and forming the insulating layer by thermally oxidizing said porous layer.

9. The method of manufacturing a field emission type cold cathode apparatus according to claim 8, further comprising the steps of:

selectively removing the thermal silicon oxide layer to expose the sharp tip portion of the emitter, followed by plating the tip portion of the emitter with a metal; and lifting off the gate metal layer with said plated metal used as a sacrificial layer.

10. The method of manufacturing a field emission type cold cathode apparatus according to claim 8, wherein said step of forming said porous layer includes formation of an n-type region within said p-type region.

11. The method of manufacturing a field emission type cold cathode apparatus according to claim 8, further comprising the steps of:

selectively etching the mother material layer except the porous layer;

loading a material differing from the material of the mother material layer in the porous layer acting as a mold; and exposing the material differing from the material of said mother material layer to the outside.

12. The field emission type cold cathode apparatus according to claim 1, wherein the depth of said concave portion is determined such that the lower portion of the emitter covering a region more than half the height of the emitter is buried in the insulating layer, and the diameter of said open portion is smaller than the diameter in the base portion of the emitter.

13. A method of manufacturing a field emission type cold cathode apparatus according to any one of claim 12, comprising the steps of:

forming a p-type region in a surface region of the mother material layer;

forming a porous layer by applying an anodic forming to said p-type region; and forming the insulating layer by thermally oxidizing said porous layer.

14. The method of manufacturing a field emission type cold cathode apparatus according to claim 13, further comprising the steps of:

selectively removing the thermal silicon oxide layer to expose the sharp tip portion of the emitter, followed by plating the tip portion of the emitter with a metal; and lifting off the gate metal layer with said plated metal used as a sacrificial layer.

15. The method of manufacturing a field emission type cold cathode apparatus according to claim 13, wherein said step of forming said porous layer includes formation of an n-type region within said p-type region.

16. The method of manufacturing a field emission type cold cathode apparatus according to claim 13, further comprising the steps of:

selectively etching the mother material layer except the porous layer;

loading a material differing from the material of the mother material layer in the porous layer acting as a mold; and exposing the material differing from the material of said mother material layer to the outside.

17. The field emission type cold cathode apparatus according to claim 1, wherein the diameter of said open portion of the gate electrode is a half or less of the diameter at the base portion of the emitter.

18. A method of manufacturing a field emission type cold cathode apparatus according to any one of claim 17, comprising the steps of:

forming a p-type region in a surface region of the mother material layer;

forming a porous layer by applying an anodic forming to said p-type region; and forming the insulating layer by thermally oxidizing said porous layer.

19. The method of manufacturing a field emission type cold cathode apparatus according to claim 18, further comprising the steps of:

selectively removing the thermal silicon oxide layer to expose the sharp tip portion of the emitter, followed by plating the tip portion of the emitter with a metal; and lifting off the gate metal layer with said plated metal used as a sacrificial layer.

20. The method of manufacturing a field emission type cold cathode apparatus according to claim 18, wherein said step of forming said porous layer includes formation of an n-type region within said p-type region.

21. The method of manufacturing a field emission type cold cathode apparatus according to claim 18, further comprising the steps of:

selectively etching the mother material layer except the porous layer;

loading a material differing from the material of the mother material layer in the porous layer acting as a mold; and exposing the material differing from the material of said mother material layer to the outside.

22. The field emission type cold cathode apparatus according to claim 1, wherein said emitter consists of an electrically conductive material differing from the material of the mother material layer.

23. The field emission type cold cathode apparatus according to any one of claim 22, wherein said gate electrode consists of an $n^+$-type silicon layer formed in a surface region of the mother material layer.

24. A method of manufacturing a field emission type cold cathode apparatus according to any one of claim 22, comprising the steps of:

forming a p-type region in a surface region of the mother material layer;

forming a porous layer by applying an anodic forming to said p-type region; and forming the insulating layer by thermally oxidizing said porous layer.

25. The method of manufacturing a field emission type cold cathode apparatus according to claim 24, further comprising the steps of:

selectively removing the thermal silicon oxide layer to expose the sharp tip portion of the emitter, followed by plating the tip portion of the emitter with a metal; and lifting off the gate metal layer with said plated metal used as a sacrificial layer.

26. The method of manufacturing a field emission type cold cathode apparatus according to claim 24, wherein said step of forming said porous layer includes formation of an n-type region within said p-type region.

27. The method of manufacturing a field emission type cold cathode apparatus according to claim 24, further comprising the steps of:

selectively etching the mother material layer except the porous layer;

loading a material differing from the material of the mother material layer in the porous layer acting as a mold; and exposing the material differing from the material of said mother material layer to the outside.

28. The field emission type cold cathode apparatus according to claim 22, wherein said emitter contains one of a low work function and negative electron affinity material.

* * * * *